US005701765A

United States Patent [19]

Cerqua

[11] Patent Number: 5,701,765

[45] Date of Patent: Dec. 30, 1997

[54] CHANGEABLE ARTICLES OF JEWELRY AND METHOD OF USING THEM

[76] Inventor: Claudio Christian Cerqua, Largo Giuseppe Veratti, 29 00146 Rome, Italy

[21] Appl. No.: 331,587

[22] PCT Filed: Mar. 30, 1994

[86] PCT No.: PCT/IT94/00040

§ 371 Date: Nov. 4, 1994

§ 102(e) Date: Nov. 4, 1994

[87] PCT Pub. No.: WO94/22341

PCT Pub. Date: Oct. 13, 1994

[30] Foreign Application Priority Data

| | | | |
|---|---|---|---|
| Apr. 7, 1993 | [IT] | Italy | RM93A0224 |
| Oct. 13, 1993 | [IT] | Italy | RM93A0690 |
| Nov. 23, 1993 | [IT] | Italy | RM93A0773 |
| Nov. 23, 1993 | [IT] | Italy | RM93A0772 |
| Mar. 30, 1994 | [IT] | Italy | RM93A0223 |

[51] Int. Cl.[6] ..... A44C 9/00

[52] U.S. Cl. ..... 63/15.4; 63/15.1; 63/15

[58] Field of Search ..... 63/15, 15.8, 1.1, 63/2

[56] References Cited

U.S. PATENT DOCUMENTS

| | | | |
|---|---|---|---|
| 221,728 | 11/1879 | Halsey | 63/15.4 |
| 414,956 | 6/1889 | Burdon | 63/15 |
| 1,224,193 | 5/1917 | Milhening | 63/15 |
| 1,327,606 | 1/1920 | Bacharach . | |
| 1,586,606 | 6/1926 | Cain | 63/15.4 |
| 1,724,130 | 8/1929 | Dayton | 63/15.1 |
| 1,999,974 | 4/1935 | Hayman | 63/15.4 |
| 2,128,644 | 8/1938 | Gittler | 63/15 |
| 2,450,762 | 10/1948 | Marshall | 63/15.2 |
| 2,812,604 | 11/1957 | Nelson | 63/15.8 |
| 4,114,398 | 9/1978 | Orlandini | 63/15 |
| 4,226,094 | 10/1980 | Wolpoff . | |
| 5,076,073 | 12/1991 | Boucheron | 63/15.4 |
| 5,228,316 | 7/1993 | Meyrowitz | 63/15.4 |
| 5,417,085 | 5/1995 | Regev | 63/15.2 |

FOREIGN PATENT DOCUMENTS

| | | | |
|---|---|---|---|
| 208719 | 6/1957 | Australia . | |
| 529168 | 3/1993 | European Pat. Off. . | |
| 518718 | 5/1921 | France | 63/15.4 |
| 2693880 | 1/1994 | France | 64/15 |
| 25697 | 3/1883 | Germany | 63/15.1 |
| 90168429 | 5/1992 | Germany . | |
| 20155 | 10/1895 | United Kingdom | 63/15.1 |
| 2210249 | 6/1989 | United Kingdom . | |

*Primary Examiner*—Flemming Saether

*Attorney, Agent, or Firm*—Beveridge, DeGrandi, Weilacher & Young, L.L.P.

[57] ABSTRACT

The appearance of a jewelry article such as a wedding ring is changed by covering a central module with a plurality of superposed blades, and/or by attaching, to a central module, one or more annular structures which have shapes, colors, or other aesthetic qualities which represent significant events such as wedding anniversaries in the life of the wearer.

7 Claims, 10 Drawing Sheets

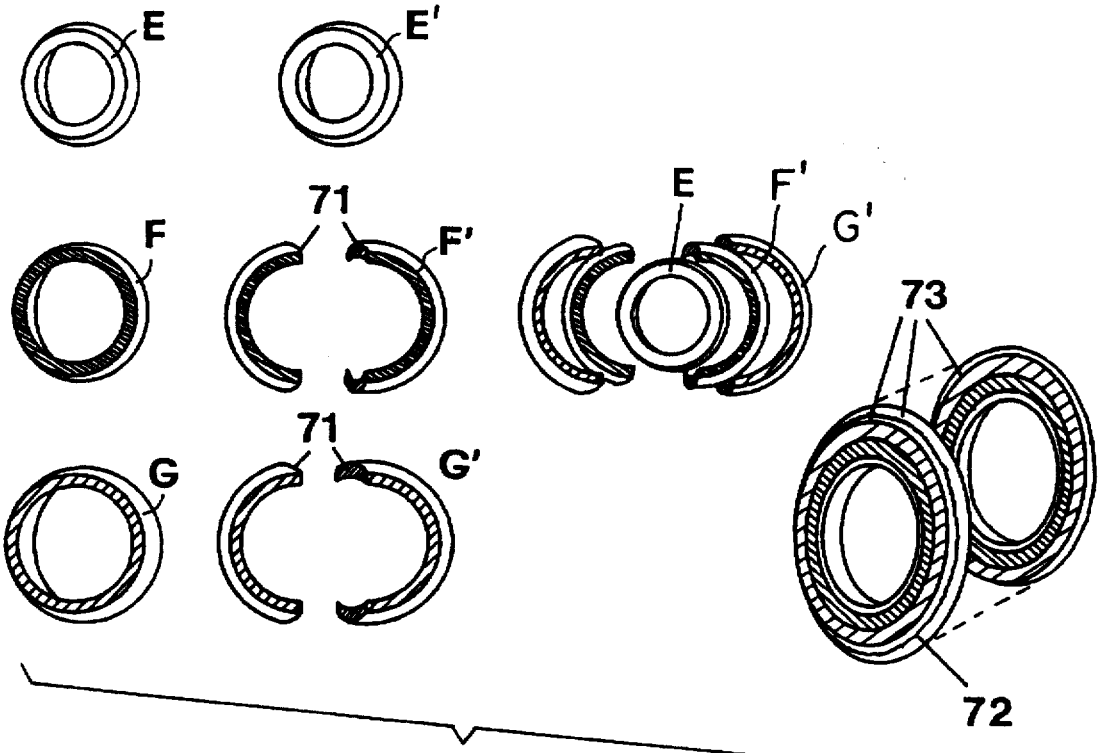
FIG. 50
FIG. 51
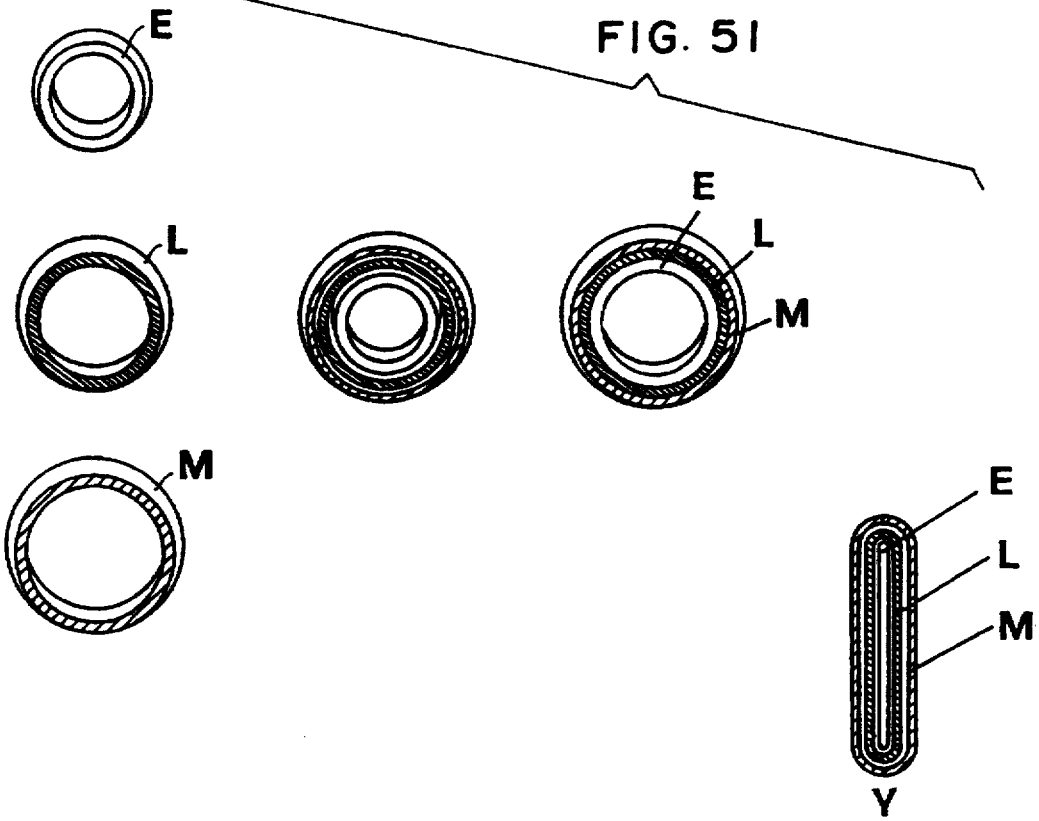

CHANGEABLE ARTICLES OF JEWELRY AND METHOD OF USING THEM

BACKGROUND

The present invention concerns a modular system for jewelry articles like wedding rings, bracelets and other articles that may be changed in color and in their external finish, with modular elements and/or with superposing layers.

It is well known that families are in the habit of remembering the most important wedding anniversaries by means of signs that underline the years passed together and renew the marriage covenant for the future. In particular, there is the custom of celebrating silver and gold weddings with the exchange of new rings, of gold or white gold, that replace the old wedding rings or are added to them.

This habit is certainly of significance for the couple and therefore the expense for the new rings after such long periods—25 or 50 years—is usually accepted.

However, there are some people who believe that new rings of a different color may reduce the symbolic value of the wedding ring, that would lose its character of unity and authenticity.

Furthermore, jewels in general, even if less than rings and other articles of attire, are subject to fashion. Until now, it has been possible to modify a jewelry article, e.g. a ring, when it no longer meets with the taste of the person who wore it, only by selling it and buying a new, different article, or by smelting the metal, recovering the eventual gems and making a new article of jewelry.

In both cases, the value of the article is usually valued on the percentage of the precious metal and on the carats of the gems, while for more complete valuation also the working cost of the jewel should be considered. However, this cost can not be recovered, especially in the case of smelting. Furthermore, a ring or any other jewel usually has a great sentimental value that gets completely lost with its selling or smelting.

The aim of the present invention therefore is to respond to the following needs:

- to allow the wedding ring to be adapted to the passing of the years, substantially maintaining the same features of the ring exchanged on the wedding day;
- to avoid the cost of buying new rings, because of the customs or because of pure aesthetical choices;
- to provide jewelry articles formed of modular elements that may be composed according to the taste of the customer;
- to provide new types of wedding rings, rings and similar articles characterized in that two, three or more superposed layers of precious metals or non-precious metals of different colors, are visible on the lateral side;
- to provide jewelry articles that may be modified without being subject to irreversible changes, with the average ability of anyone using suitable tools, and in any case with the quick intervention of a person skilled in the art;
- to provide a modular system which allows additions and/or variations to the decorative elements of rings, bracelets and other articles of jewelry or inexpensive jewelry.

Such additions or variations or completions respond to the need that, instead of an engagement and/or wedding and/or silver- or gold-wedding ring, one single structure may be used to which the various components may be added, even if bought at different times.

In a similar manner needs may be met to vary, according to the tastes and the occasions, the decorative elements of rings and other jewels, making use always of the same modular structure.

SUMMARY

An object of the present invention, as claimed in the following claims, is to solve the problem of providing a jewelry article, in particular a wedding ring, that may be modified in its color and in its external finish and which, from a general point of view, is characterized in that it comprises an annular supporting element and at least one metal blade for covering said annular supporting element, linked to the same and for its external covering, without use of adhesive means and that may be removed by means of a cut.

The covering blades may be of different metal alloys and of different colors, or even colored in different manners so as to define the different periods of marriage life. For modifying the ring, the blades may be added or removed. When they are added and if the starting blades are cylindrical, they may be applied onto the ring, by means of spinning, while if the starting blades are plane they may be plastically deformed and welded to the opposite ends, or also fixed by means of two or more small disappearing screws to a wedding ring which was not provided with such blades.

When a ring, provided with said blades, is to be modified, said blades must be cut and removed.

Furthermore, an object according to the present invention is to solve the problem of providing a jewelry article, in particular a ring, that may be modified in its shape and color and which, from a general point of view, is characterized in that it comprises an annular supporting element, delimited by internal and external cylindrical surfaces, whereby the latter one is laterally provided with circumferential reliefs for forming a central groove, and at least one external additional annular element which modifies the aesthetics of the ring, that has an internal groove which may be engaged in and joined with said annular supporting element in correspondence with at least one of said circumferential reliefs.

In a possible variant, the present invention also solves the problem of providing a ring or jewelry or inexpensive jewelry, with modular elements which, from a general point of view, is characterized in that it comprises, as modular elements, a substantially tubular supporting base body, provided, at least at one of its ends, with an external threading; and at least one internally threaded nut, that may be coupled with said external threading of the base body and retained on the same.

In some preferred embodiments of the present invention, the ring according to the present invention comprises furthermore at least one additional external annular element which modifies the aesthetics of the article, inserted onto said base body and kept there by means of said threaded nut, and one circumferential relief of said base body, or also by means of a couple of nuts in threaded coupling with the corresponding threadings of the ends of said base body.

In a further variant, the ring according to the present invention comprises a base body showing, peripherally and transversely, a plurality of grooves provided with undercuts and having a length equal to the transverse dimension of said base body, and a plurality of curved laminar elements, whereby each laminar element may be transversely inserted in successive grooves or non-successive grooves, and laterally blocked by means of threaded nuts.

Among the above mentioned aims, the one of providing a modular arrangement without screwing is solved by means of a variant of the present invention, comprising a supporting structure with components connected by a pressure fit, a release, a joint, a bayonet or with grooved guides insertion. The modules may be applied from one or both sides, and they may be shaped and decorated according to the wishes of the owner, and linked to said supporting structure so as to form a unit.

Furthermore, said annular structures may have the same insertion means provided in said supporting structure, so as to allow the addition of further elements in succession or for replacement.

For providing the variant of the system concerning rings or other jewels consisting of superposed metal layers, the present invention provides a process comprising the use of a tubular structure with a plurality of layers of different metals, formed by the forced insertion of coaxial tubes one into the other, or by wrapping up and welding metal sheets, or by various deposits of electroplating performed in succession. The tubular structure is cut with tools perpendicular to the axis of said composed tube, thus forming rings with three-layer edges.

Further features and advantages of the present invention will be described more in detail hereinbelow, according to the enclosed drawings in which some preferred embodiments are shown:

BRIEF DESCRIPTION OF THE DRAWINGS

FIG. 39 shows a lateral scheme of a modular system with grooved guides;

FIGS. 40 and 41 show an exemplified front and lateral view of a system for the application of the upper part onto a modular ring with a dovetail joint;

FIG. 42 shows the components of a modular ring with a screw application system or similar;

FIG. 50 shows two variants of the manufacturing process in which half-wedding rings of different diameters formed of welded rings, divided in two parts, and then mounted in succession around the central wedding ring E for obtaining the final ring with three layers; or of annular weldings for uniting hollow half-wedding rings, cut along a central vertical plane passing through the center;

FIG. 51 shows a process for providing the three-layer wedding rings, obtained with wedding-rings of different diameters inserted one into the other and brought into contact due to expansion from inside, and the variant in which the wedding rings consist of hollow-shaped metal covers.

DESCRIPTION OF THE PREFERRED EMBODIMENTS

Figure 1:
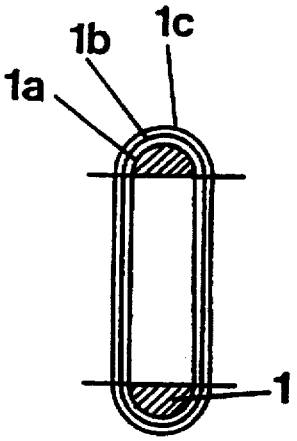
FIG. 1 shows a cross section of a first embodiment of a ring according to the present invention.

The enclosed figures show a modular system for providing rings, bracelets and other articles of jewelry in which the annular supporting element 1 of FIG. 1 has a surface which, in cross section, is semicircular.

Figure 2:
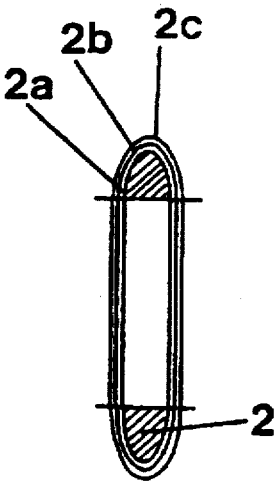
FIG. 2 shows a cross section of a second embodiment of a ring according to the present invention.

The supporting annular element 2 of FIG. 2 has a surface which, in cross section, is a semi-ellipse.

Figure 3:
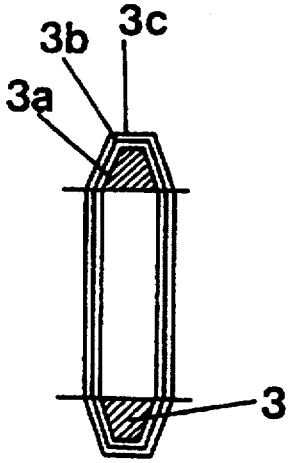
FIG. 3 shows a cross section of a third embodiment of a ring according to the present invention.

The supporting annular element 3 of FIG. 3 has a surface which, in cross section, is polygonal, specifically a trapezium.

Obviously, the supporting annular element may have a section different from the ones shown, flat or with a different shape.

Figure 4:
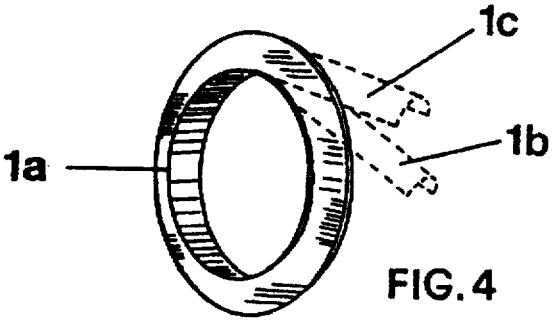
FIG. 4 shows a perspective view of one of the embodiments of the ring according to the present invention, partially cut for illustrating purposes.
Figure 5:
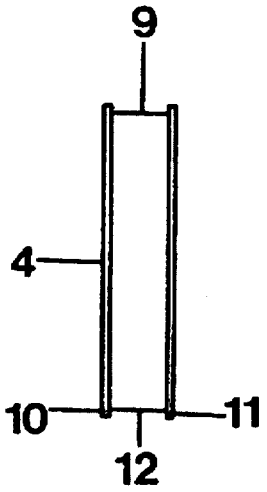
FIG. 5 shows a front view of an annular supporting element for a jewelry article.

The metal covering blades 1*a, b, c,* 2*a, b, c* and 3*a, b, c* conform to the respective supporting elements by means of plastic deformation. Such deformation may take place by the direct spinning of a cylindrical blade onto the corresponding ring, i.e. curving a plane blade to the shape of a ring, whereby said blade is shaped with a transverse section corresponding to the shape of the annular element, applied to the same and welded or otherwise fixed to its free ends as shown in FIG. 4. The blade on the supporting element and the superposed blades are united without adhesive means, while the same connection, obtained by plastic deformation of one blade with the ring or with the adjacent blade, may be released by means of a cut.

Figure 49:
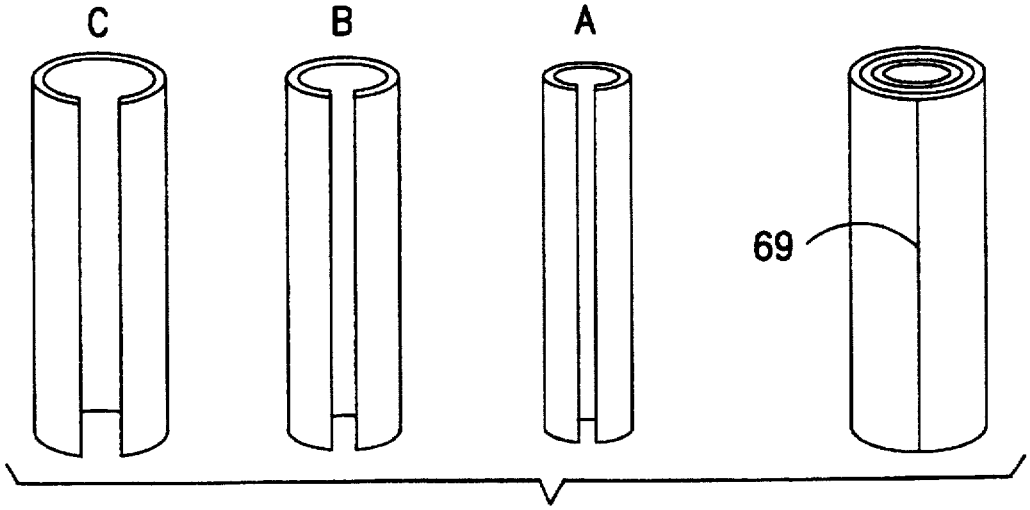
FIG. 49 shows metal coverings A, B and C, to be inserted one into the other and welded along the edges for obtaining a three-layer tube.

According to a further possible embodiment, the starting point may be a tubular element previously drawn to a plurality of layers. Turning with a hollow diamond iron produces a ring with a corresponding half-round shape, and turning with a pointed diamond iron produces a ring with a mainly flat shape. In both cases, a ring according to the present invention is obtained, in which, on the lateral edges, the colors and the thicknesses of the drawn blades can be seen together with the supporting element, as shown in FIG. 49.

One or more metal covering blades may eventually display a surface with decorations. The number of the blades may usually vary from one to three, but conveniently there are two.

As shown in FIGS. 5, 6, 7, 8, 9, 10, 11, 12 and 13, a supporting annular element 4 has a cylindrical internal surface 8 and by a cylindrical external surface 9. The external cylindrical surface 9 is provided at its sides with circumferential reliefs 10 and 11 for forming a central groove 12.

The supporting annular element 4 is a part of the jewelry article according to the present invention: in its most immediate shape it might be, for exemplifying but not limiting purposes, a part of a ring, i.e., a jewelry article to wear on a finger. However, it might also be used for earrings, brooches and other articles comprising a substantially annular part.

The jewelry article according to the present invention furthermore mainly comprises at least one external additional annular element 5*a*, 5*b*, 5*c*, . . . 5*n*, that modifies the aesthetics of the article. Each external additional annular element may be formed of the desired metal alloys, and have the required external shapes by means of the desired working and finish. It must have an internal shape that allows at least a partial insertion into the central groove 12 of the supporting annular element 4 and a removable joint engagement with the same in correspondence with at least one of the circumferential reliefs 10 and 11. This is made possible by at least one corresponding groove obtained in the internal surface of the additional annular element 5*a*, 5*b*, 5*c*, . . . 5*n*, shown in FIGS. 6, 7, 8, 9, 10, 11, 12 and 13, in which the same or similar numbers show the same or similar elements.

Figure 6:
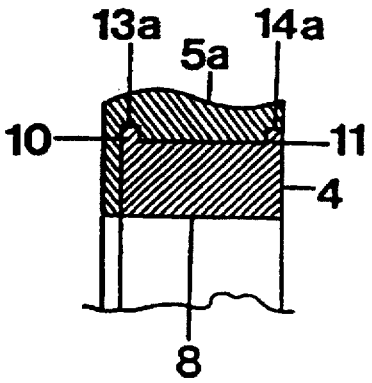
FIGS. 6, 7, 8, 9, 10, 11, 12 and 13 show a partial cross section of the annular supporting element of FIG. 5, as well as alternative shapes of additional external annular elements for the supporting annular element.

FIG. 6 shows a jewelry article or, as it will be called for simplicity, a ring, in which the supporting annular element 4 is completely covered by only one additional annular element 5*a*. This additional element has an L-section and has two grooves 13*a* and 14*a*. The groove 13*a* may releasably engage the circumferential relief 10, due to the elasticity of the metal alloy of the additional annular element 5*a*, while the groove 14*a* will overlie the circumferential relief 11 after the release insertion. It is obvious that the external shape of the additional annular element 5*a*, like the one of all elements described hereinbelow, may be different from the smooth and plane one shown in FIG. 6 and in the following figures.

Figure 7:
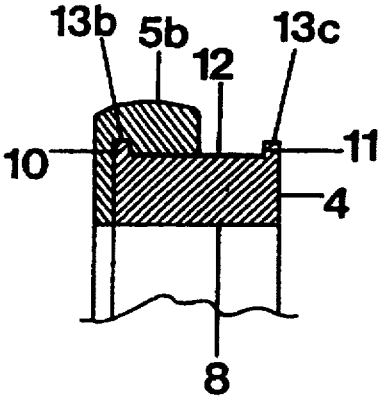
Figure 8:
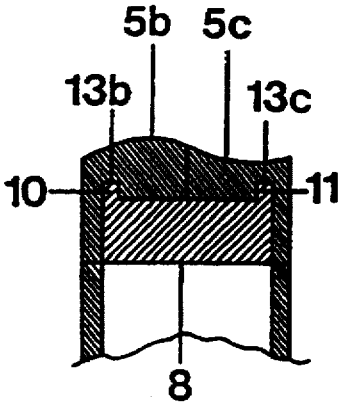

The supporting annular element 4 shown in FIG. 7 is only partially covered with an additional annular element 5*b* with a transverse L-section. Of course, this layer covers only half the annular element, might have an aesthetic function. In the embodiment according to FIG. 8, an additional annular element 5*b* is provided with a release insertion, as well as an annular element 5*c*, which has the identical specular shape. The grooves 13*b* and 13*c* get inserted onto the corresponding circumferential reliefs 10 and 11 of the supporting annular element 4.

Figure 9:
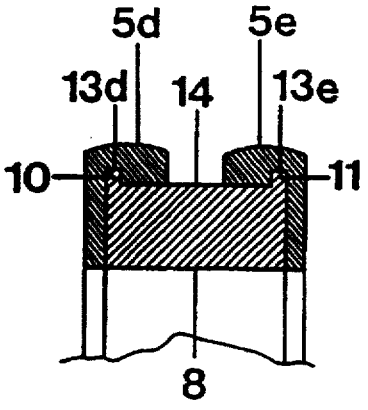
Figure 10:
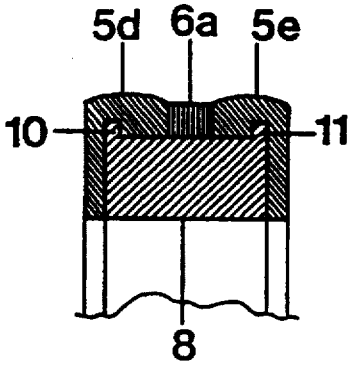
Figure 11:
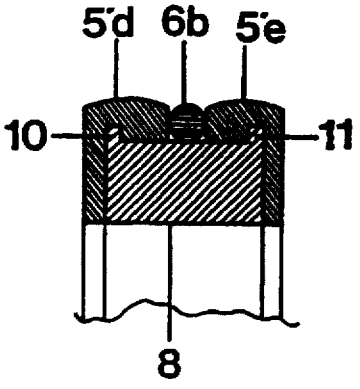

In the embodiment according to FIG. 9, the supporting annular element is partially covered by two additional annular elements 5*d* and 5*e* with grooves 13*d* and 13*e* which receive the reliefs 10 and 11. In the embodiment according to FIG. 10, the central groove space which is not covered by the two additional, opposed annular elements 5*d* and 5*e* is occupied by an additional annular element 6*a* with a polygonal section, without any circumferential groove. In the embodiment according to FIG. 11, the same space is occupied by a further additional annular element 6*b* with a circular section, also without a circumferential groove.

Figure 12:
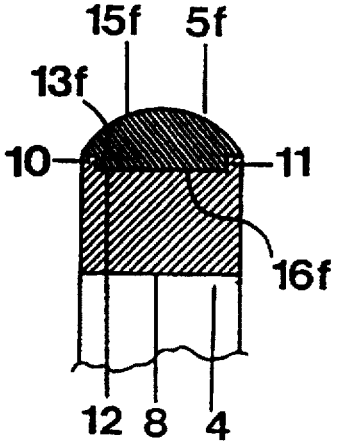

In the embodiment according to FIG. 12, an additional annular element 5*f* has a section comprising an external portion 15*f* with a decorative shape and finish, e.g. curved, and an internal portion 16*f* complementary to the shape of the central groove 12 of the supporting annular element 4, and complementary to the reliefs 10 and 11 with the grooves 13*f* and 16*f*. The external additional annular element has, in this case, an open shape that is then curved as a ring for being coupled with the supporting annular element by means of welding at its two ends.

Figure 13:
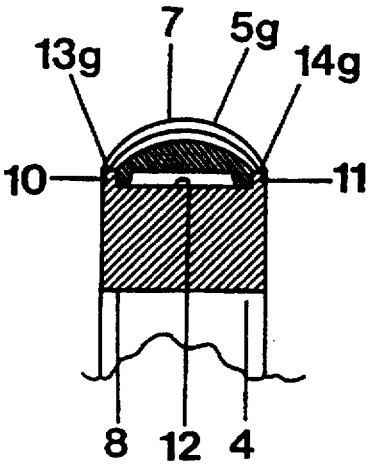

In the embodiment according to FIG. 13, the jewelry article comprises an external additional annular element 5*g* in the shape of a solid with a surface which, in cross section, is semicircular. This is a semi-toroidal surface, obtained by the rotation of a half-circumference around a straight line at its side, externally covered by two modeled covering metal blades 7 and internally provided with means that engage with the circumferential reliefs 10 and 11 in the central groove 12. The reliefs may eventually be elastic tongues provided on the circumference, each of which is inserted in the central groove 12 abutting against the reliefs 10 and 11 of the supporting annular element 4, whereby said reliefs may form undercuts with the cylindrical surface of groove 12. In this case, grooves 13*g* and 14*g* of the additional annular element are defined by said elastic tongues and by the section side.

The corresponding covering metal blade 7 is linked to the additional annular element 5*g*, for its external covering, without use of adhesive means and may be released by means of a cut as shown in dotted lines in FIG. 4.

Figure 14:
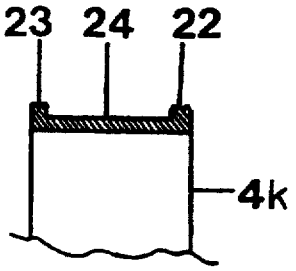
FIGS. 14, 15 and 16 show in a partial diametrical section, the elements composing another embodiment of a jewelry article with modular elements.
Figure 15:
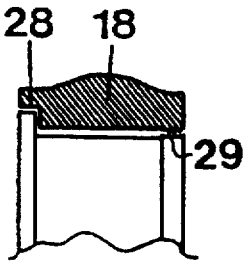
Figure 16:
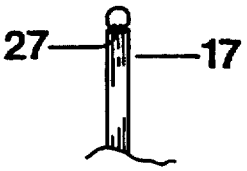

Referring to the modular system shown in FIGS. 14, 15, 16, 17, 18, 19, 20, 21, 22, 23, 24, 25, 26, 27, 28, 29 and 30, in a first embodiment shown in FIGS. 14, 15 and 16 the annular article according to the present invention comprises a base body 4*k*, or supporting element, provided at one end with an external threading 22. The opposite end of the base body 4*k* has a circumferential relief 23. On said base body 4*k*, with a large sliding coupling, an external annular element 18 may be inserted as an element for decorative purposes, said element being provided with a circumferential internal cavity 28 that covers, or at least enters into contact with, the relief 23 of the base body 4k. The external annular element 18 may be retained on the base body 4k, by means of an internal threading 29 in the end opposite to the circumferential cavity 28 or, if there is no internal threading 29, by means of a nut 17, externally smooth or appropriately shaped and internally threaded as shown at 27. As can be seen in FIGS. 14, 15 and 16, the external threading 22 has an external diameter greater than the maximum one of the base body 4k, if the circumferential relief 23 is excluded, so that between the base body 4k and the external annular element 18 after assembling of the annular article a more or less wide cavity may exist. Of course, without said external annular element 18, the same external surface 24 of the base body 4 might be finished or polished with different elements, like set gems or other elements not shown.

The threaded coupling of the annular element 18 and of the nut 17 may be secured by means of a small blocking screw (not shown) which is threaded into the base body 4k or by welding.

Figure 31:
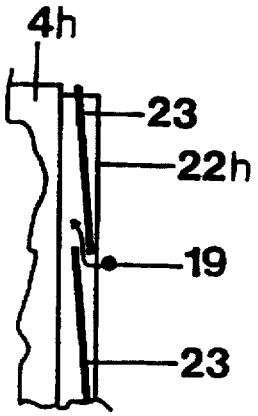
FIG. 31 shows in a schematic detail of an annular article with modular elements.
Figure 30:
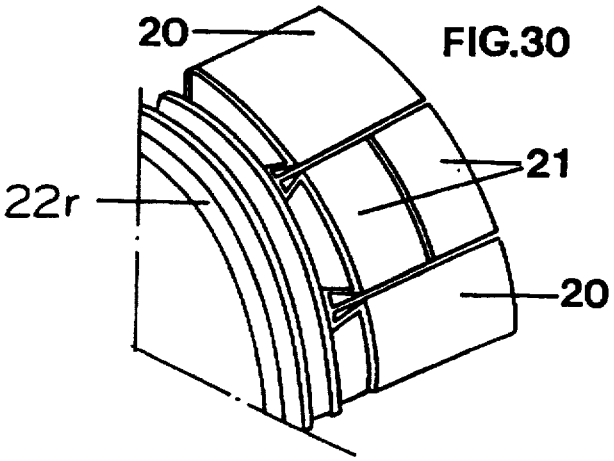
FIG. 30 shows a partial axonometric view of the embodiment according to FIG. 29.
Figure 32:
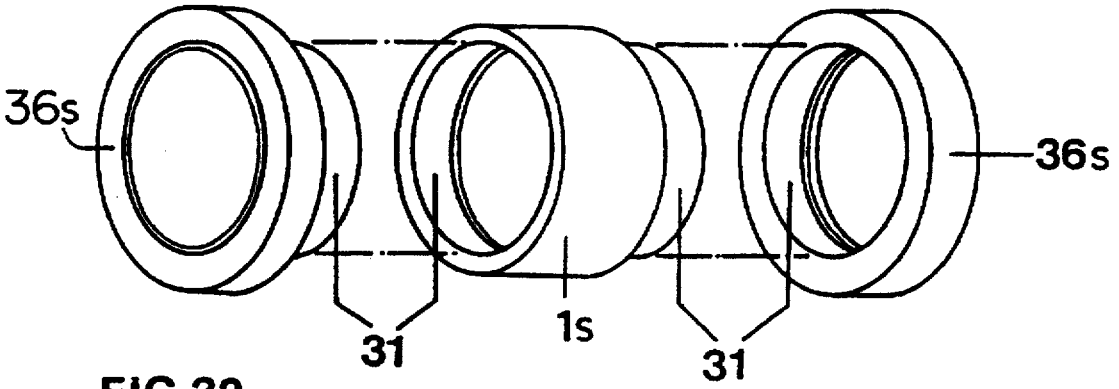
FIG. 32 shows an exploded axonometric view of the components of a modular system with a pressure insertion means for utilization of a wedding ring and/or of a ring.
Figure 33:
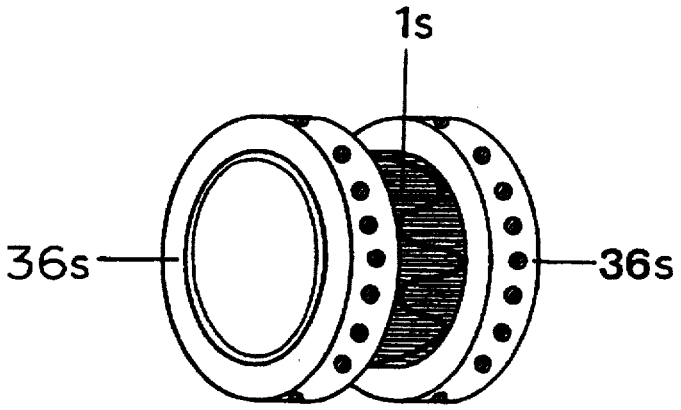
FIG. 33 shows a ring obtained by utilizing the elements according to the preceding figure, with exemplifying decoration.
Figure 34:
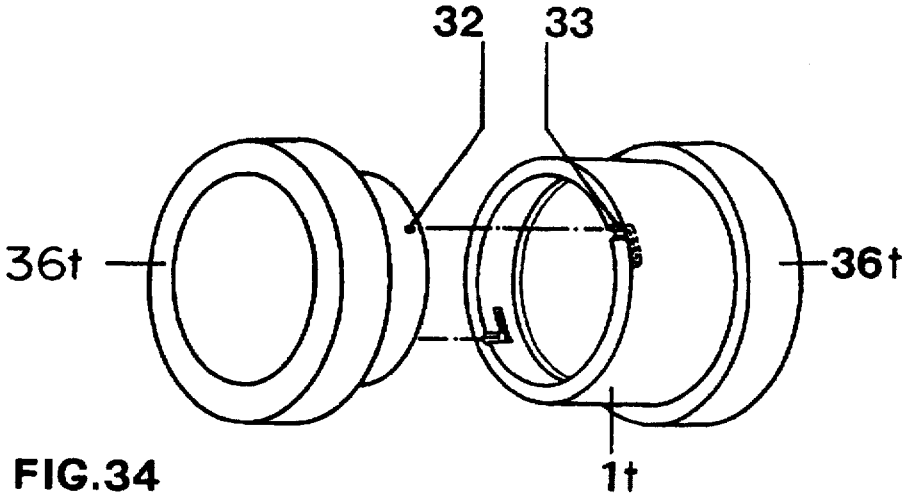
FIG. 34 shows an axonometric view of some components of a modular system with a joint insertion means.

Said threaded coupling may be part of a bayonet-joint shown schematically in FIG. 31, where a pawl 19, due to a partial rotation, engages with parts of threadings 23 on the base body 4h.

In the embodiment shown in FIGS. 17, 18, 19 and 20, the annular element comprises a supporting base body 4m provided at each end with an external threading 22m, having an external diameter equal to the external diameter of the base body 4m. On base body 4m, an external annular element 18m may be inserted with a sliding, more or less precise coupling, as a modifying element of the external aesthetic and decorative appearance of the article, that may be finished and polished with set gems and other elements, not shown. The external annular element 18m may be held by both ends on the housing base body 4, by a first externally threaded nut 17m and a second nut 17m' with at least one set gem 26.

Figure 17:
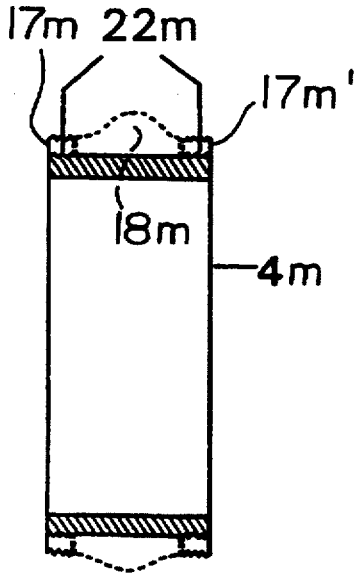
FIGS. 17, 18, 19 and 20 show a diametrical section of the elements composing still another embodiment of a jewelry article with modular elements.
Figure 18:
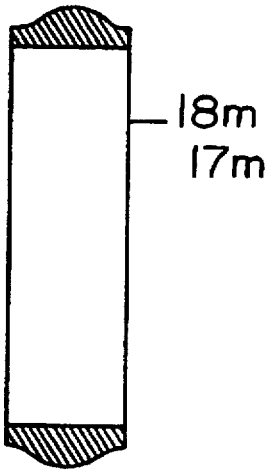
Figure 19:
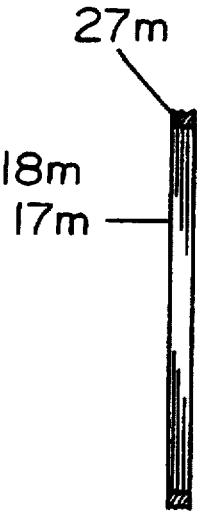
Figure 20:
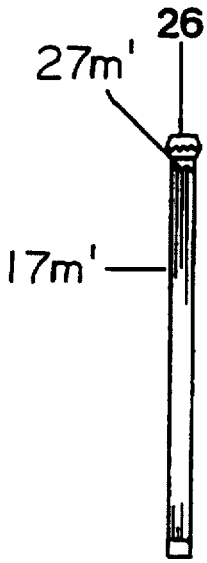

FIG. 17 shows, in dotted lines, modular elements 17m and 18m mounted onto the base body 4. The blocking of the nuts 17m onto the base body 4 takes place as above described.

Figure 21:
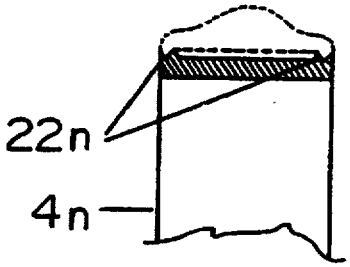
FIGS. 21 and 22 show, in a partial diametrical section, the elements of a further article with modular elements.
Figure 22:
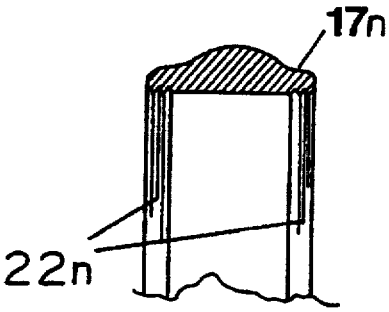

In a further possible embodiment shown in FIGS. 21 and 22, the annular article comprises a supporting base body 4n provided, at each end, with an external threading 22n with an external diameter greater than the external diameter of the base body 4n. Onto said base body 4n, only one nut 17n may be inserted by screw coupling for modifying the aesthetics of the article, and that may be finished or polished with set gems and other elements, not shown. The threadings 22n of the base body 4n have the same direction while where there is one single nut engaged by its own two threadings 27n with said two threadings 22n, the latter ones may have different or opposite directions. In this embodiment, the width of the nut 17n is equal to the transverse dimension of the base body 4. In the embodiment shown in FIGS. 21 and 22, even if not particularly illustrated, a third central threading may be provided on base body 4n between the threads 22n so as to engage nuts which are equal to or different from those shown in FIGS. 16, 19 and 20.

Figure 23:
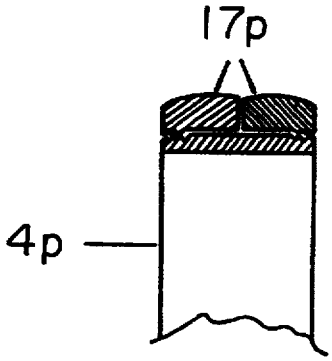
FIGS. 23 and 24 show, in a partial diametrical section, another embodiment of the article with modular elements.
Figure 24:
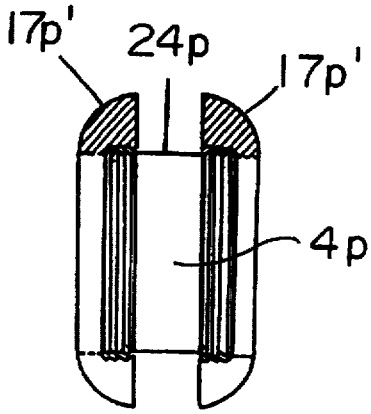
Figure 25:
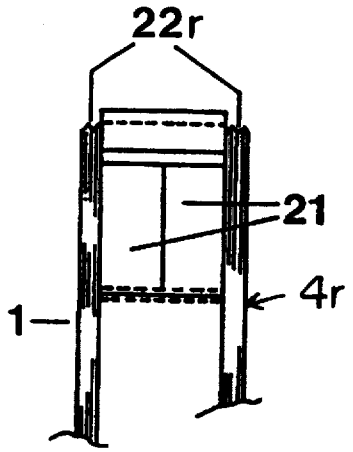
FIGS. 25, 26, 27 and 28 show, in a partial diametrical section, elements composing still another embodiment of the article with modular elements.
Figure 26:
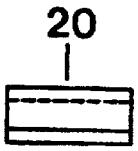
Figure 27:
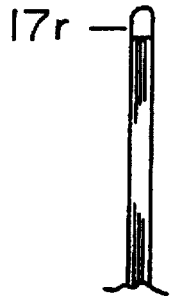
Figure 28:
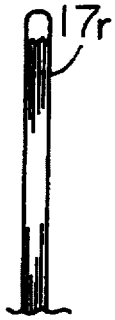
Figure 29:
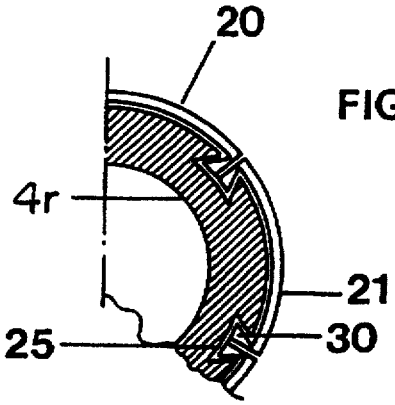
FIG. 29 shows a central, partial square section of a further embodiment of the article with modular elements.

In the embodiment shown in FIG. 23, the annular element comprises a supporting base body 4p provided at each end with an external threading which has an external diameter equal to the one of base body 4. Onto said base body 4p may be inserted, by screw coupling, two opposite nuts 17p that abut to cover the base body 4, while FIG. 24 shows the two nuts 17p' in the shape of half-wedding rings, assembled at a distance so as to leave open part of the surface 24p of the base body 4p. The nuts 17p' may be externally finished or polished with set gems or other elements, not shown. The threadings of the base body 4p may be, in this case, of the same or of different directions.

In the embodiment shown in FIGS. 25 to 30, the annular article comprises the supporting base body 4r provided at both ends with an external threading 22r, having an external diameter smaller or equal to that of the base body 4r. Said base body 4r has a plurality of peripheral or transverse grooves 25. In the enclosed figures, said grooves are shown as having a dovetail section, but they might be also T-shaped or having any other undercut. The grooves 25 have a length equal to the transverse dimension of the base body and they cut through the threadings 22r, if these threads are of equal diameter to the maximum external diameter of the base body 4r. In this embodiment, two nuts 17r, threaded on their internal surface, may be coupled with the external threadings of the base body 4r. A plurality of laminar curved elements is provided, like the thin sheets 20 of FIG. 30, each having dimensions such as to get engaged with at least two successive or non-successive grooves 25. At the ends of the sheet 20, there are internal radial projections 30 with a shape complementary to the half-section of said grooves. Each one of said curved elements 20, which may be externally finished or provided with aesthetical elements, may be transversely inserted into the grooves 25, and be laterally blocked by means of the threaded nuts 17r. As an alternative, a plurality of curved laminar elements 21, of a width smaller than the transverse dimensions of the base body 4r, submultiple of the same, may be transversely inserted into the same grooves 25 and may be laterally blocked by means of threaded nuts 17r. Said curved elements 20 and 21 may be smooth or finished on the surface, with reliefs or engravings of letters and numbers, of ideograms or similar. They may have set gems or other decorative features that may be combined according to tastes.

According to the variants of the modular system, different from the above mentioned screwing system, the following components are shown in FIGS. 32, 33, 34, 35, 36, 37, 38, 39, 40, 41, 42, 43 and 44:

- a central ring-like module 1s, provided with end means 31 being lower or higher than its surface for a pressure insertion, or a module 1t with means 32 and 33 for a bayonet joint, or a module 1w with means 34 for a release insertion or with means 35 for a dovetail connection of the peripheral structures;
- a plurality of peripheral annular structures 36s, 36t, 36w, 36x, 36y provided with means for being linked to said central module, corresponding to those provided on said module, with different shapes, decorations and dimensions.

Figure 43:
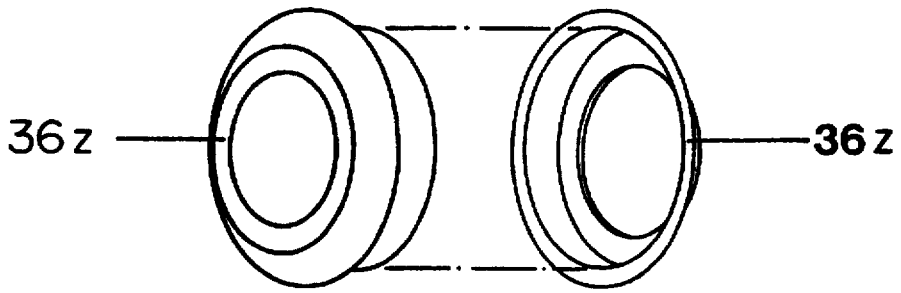
FIG. 43 shows the direct coupling of two portions of a wedding ring formed without a central support.

The embodiment disclosed in FIG. 43 allows the direct coupling of two annular structures 36z without the need of a central module for wedding rings or similar with different structures.

In the case of joint connection means or connection means of FIG. 39 with grooved guides 37, provided at the center of the external band of the central module 1x, the present invention provides means for blocking the coupled parts and eventual means for the aesthetical covering of the uncovered guide.

Figure 35:
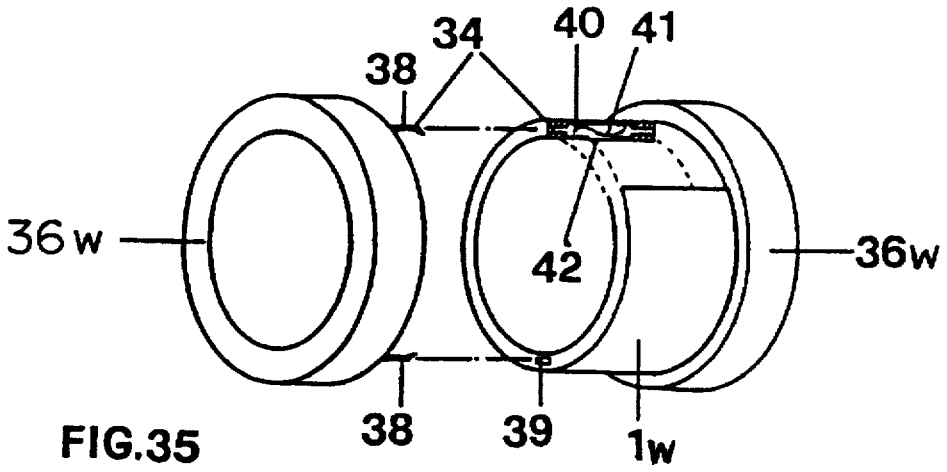
FIG. 35 shows the components of a modular structure with release insertion means.

For what concerns the variant shown in FIG. 35, the means 34 for the release insertion provides the presence on the lateral edge of the central module 1w and/or on the peripheral structures 36w, of one or more hooks 38 or similar elements that may be inserted into opposite openings 39 so as to overcome the resistance of springs 40 and engage internal hooks 41 on the springs from which they may be unhooked, in case of detachment of the components, through openings 42 provided on the internal surface of module 1*w* and/or of the structures 36*w*.

Figure 38:
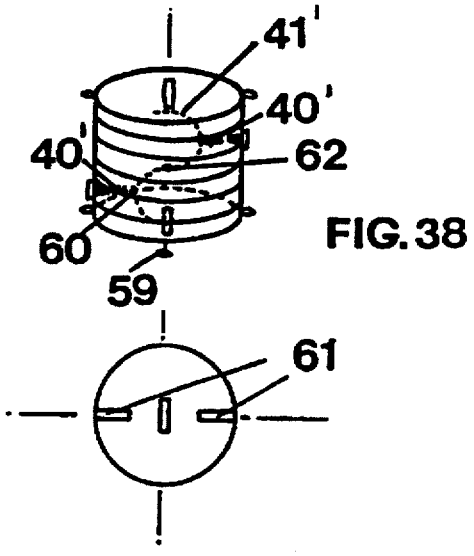
FIG. 38 is an axonometric and lower view showing the details of a small block with the functions of a spring-catch.
Figure 36:
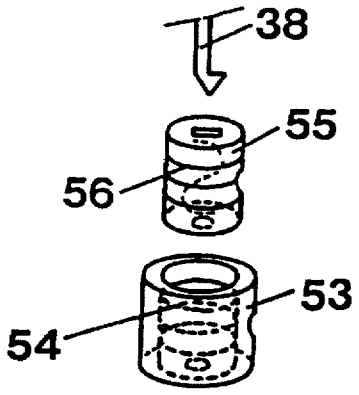
FIG. 36 shows a variant of the release system that may be applied to spring-catches and similar for allowing to replace parts without welding.
Figure 37:
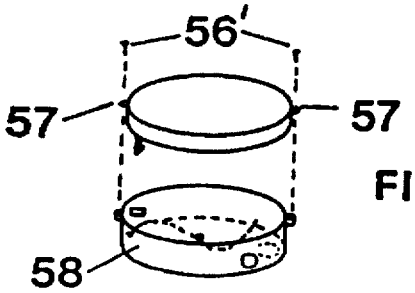
FIG. 37 shows, in an exploded axonometric view, a variant of the flat form of the release system.

In applying the concept according to the present invention to spring-catches, as shown in FIGS. 36, 37 and 38, a container 53 is shown with an internal threading 54 to be inserted by welding into any hole provided onto the central structure 1*w* or on the annular structures 36*w*, for subsequently receiving by screwing the sector 55 with external grooves 56, containing the means for the release assemblage. The container 53 and the sector 55 may be of different shapes for being assembled with screws or in other ways as shown, for example, in FIG. 37 where the screws 56' may be applied through eyelets 57 of the ultraflat container 58.

Such solution allows to obtain a lock with removable internal springs, that may be removed without replacing the whole lock, and to make ready for use complete parts and sectors of jewelry articles.

In the alternative spring-catch mechanism according to FIG. 38, the following elements are provided:

a rod 59 for disengaging the hook 38;

screws for blocking the springs 40';

a pawl 60 for the seats of the springs 40';

grooves 61 for receiving a tool for unscrewing the small block;

a central pin 62 around which the internal hooks 41' rotate.

In the variant according to FIG. 39, the coupling means consists of a plurality of external access grooves 43, provided in the module 1*x* to intersect the central groove 37. When a tooth or similar element, placed inside each annular structure 36*x* is inserted into one of said grooves 43, and reaches the central groove 37, followed by the rotation of the parts, the components will be connected, be it for rings as well as for bracelets, for medals and eventual compositions of parts of wordings onto articles of jewelry.

In the case of the dovetail application system, as shown in FIGS. 40 and 41, the insertion of the projections 44 between the wedges 45 together with a slight rotation are sufficient for providing stability to the ring.

Figure 42:
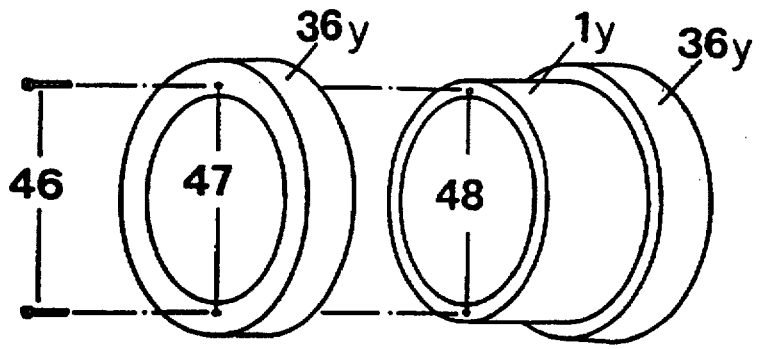

In the embodiment according to FIG. 42, the coupling system of the parts involves the insertion of small screws 46 into transverse passing through holes 47, provided in structures 36*y* and in the blind holes 48 onto central module 1*y*.

Figure 44:
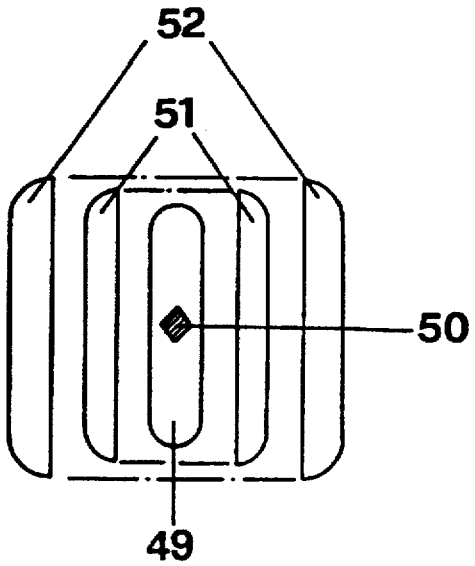
FIG. 44 shows in a lateral exploded view a series of wedding rings with hollow spaces inserted into the other.
Figure 42:
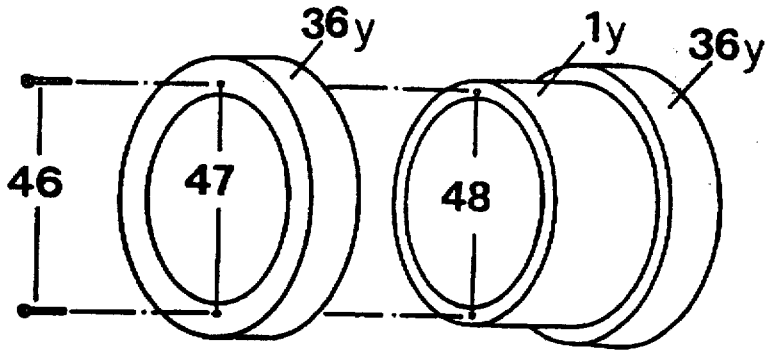
Figure 43:
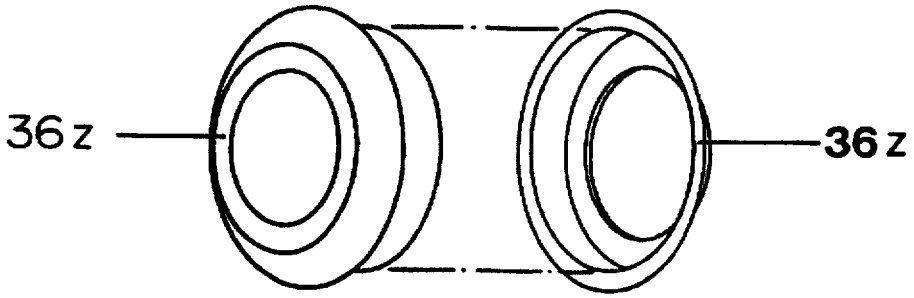
Figure 44:
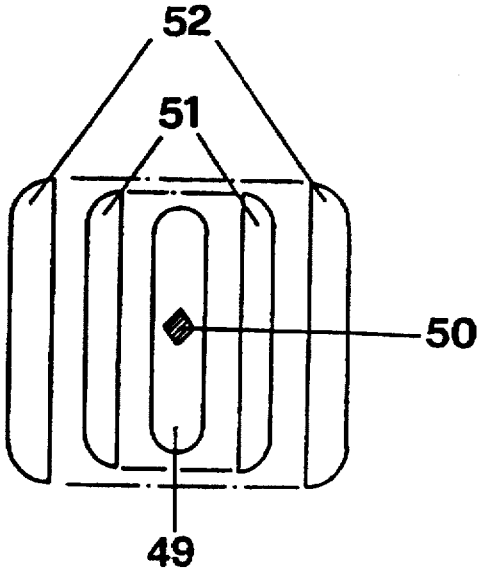
Figure 45:
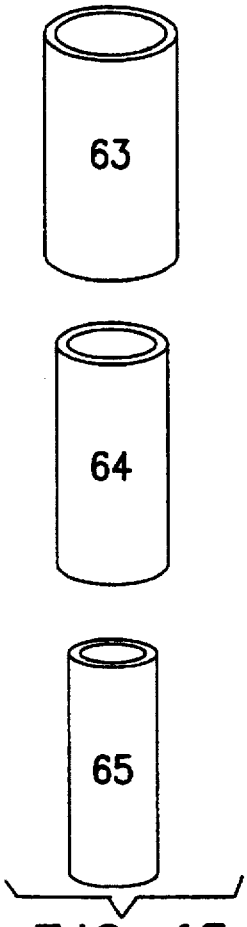
FIG. 45 shows an exploded view of the tubes 63, 64 and 65 to be inserted one into the other as shown in FIG. 46, illustrating the process of making wedding rings, rings and similar, with a plurality of superposed layers of different metals and colors.

The adoption of the system according to the present invention, in all above mentioned variants, may be associated with the product shown in FIG. 44 consisting, in an original manner, of three modular wedding rings, inserted with hollow shells one inside the other so as to show an internal module 49, out of white gold or platinum with an eventual small diamond 50, enclosed in the white gold hollow shell 51 for silver wedding, and all this in turn enclosed in a hollow red gold or golden wedding ring shell 52, allowing the use of all components together or the addition or replacing of the single parts, according to the choices and the events.

In one and the same article of jewelry, a plurality of the above mentioned variants of the modular system according to the present invention may be combined. By making use of said access grooves 43 and of the central groove 37, different articles may be made, like:

rings in which the upper parts or the stem may be completely or partially replaced;

bracelets in which the upper part or sectors may be replaced, or with settings or drawings that may be inserted.

With the application of the release insertion system with hooks 38 and openings 39, bracelets may be provided with small blocks carrying single letters that may be composed for spelling a word.

In the application of the screwing system, necklaces may be provided in which the lock may be completely or partially replaced by means of male and female threadings. In a similar manner, said necklaces with a replaceable lock may be connected with the release system.

With the variant of the grooves 37 and 43, medals may be decorated with additional means, closed in a small pressure frame.

Also according to the present invention, original modular systems for providing bracelets and other jewelry articles, in particular consisting of superposed layers of metals of different colors, are shown in FIGS. 45, 46, 47, 48, 49, 50 and 51.

Relating to said figures, the manufacturing process for wedding rings, rings and similar with three superposed metal layers of different colors, according to the present invention, may be described as follows:

a tube 63, of a metal that may be platinum or white gold, is inserted under pressure into tube 64 of gold, and all together into a tube 65 of red gold or other metals, making them stable by welding or other means, obtaining a three-layer tube;

said three-layer tube 63-64-65 is cut with an iron perpendicularly to its axis for obtaining rings 66 with sharp, not finished, edges.

Figure 46:
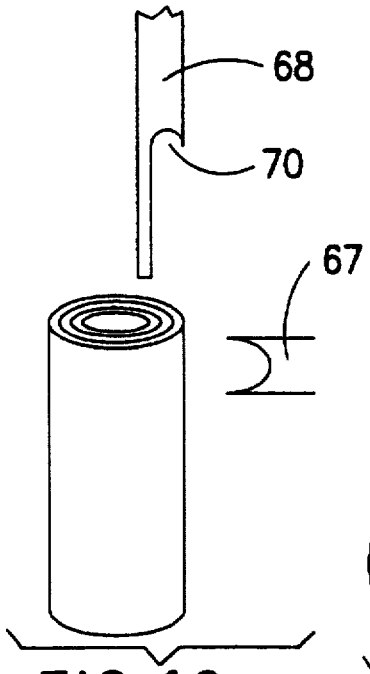
Figure 48:
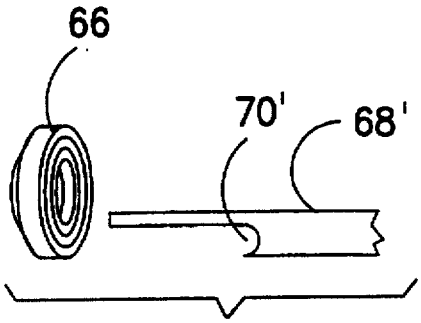
FIG. 48 shows a phase of the finish process for wedding rings or rings, performed with a tool provided with an appropriate shape for rounding the edges so as to obtain rings like the one shown in a section in FIG. 1.
Figure 47:
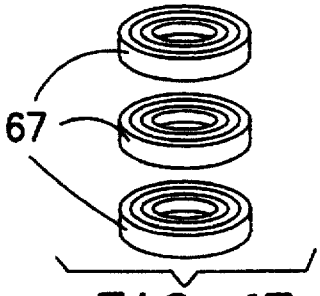
FIG. 47 shows the process in which a tube with multiple layers 63, 64 and 65 is divided by cuts to form rings, which are then finished to remove sharp edges.

In the variant of the process shown in FIGS. 46 and 48 the following phases are performed to obtain a finished wedding ring or ring:

with an iron 68, the inner side of tube 63-64-65 is faced in axial direction until the shape 70 is obtained, that blunts it laterally; now the concave iron 67 is applied vertically to the axis of the tube 63-64-65, so as to join the blunting, shapes the wedding ring and cuts it;

the wedding ring, which still has a sharp cutting edge, is turned upside down and is inserted inside expansion pliers and the blunting is completed with a second iron 68'.

In a further variant of the process according to the present invention, the three-layer tube is obtained by the subsequent welding 69 of open blades or covers A-B-C of different metals and colors.

An important variant of the process according to the present invention provides the deposit by electroplating, of subsequent metal layers onto single wedding rings or onto tubular structures to be cut, making use of solutions of the respective salts, with a final polishing, i.e. the electrolytical removal of the outer layers.

The process shown in FIG. 50 is a variant of the one described in connection with FIG. 49 where, instead of the metal covers A-B-C, welded along edges 69, the wedding rings F and G are cut either into two parts F' and G', or into two parts F" and G" so as to be subsequently mounted and welded at 71 or at 72, 73 around the central wedding ring E.

In a similar manner, a three-layer ring may be made by means of the variant described in FIG. 51: said ring is obtained by the forced expansion of wedding rings E-L-M, of different diameters, that may be inserted one into the other.

According to the process of the present invention, an already existing wedding ring may be covered with one or more layers of metals of different qualities and colors, by means of casts that provide two lateral small rings, each one of them covers half of the wedding ring, and these small rings are then welded or united under pressure. On these rings, further layers of different metals may be superposed in succession, according to the purpose.

The process making use of die-casting provides the following operating steps:

in vulcanized rubber, a recess having a shape corresponding to the structure of a wedding ring, slightly larger than the one to be covered, is made; the wedding ring is inserted into the rubber; the whole is covered with wax; die-casting with lost wax is performed, obtaining a metal cover instead of the wax; the whole process is repeated for all superimposed layers, as needed;

the first wedding ring is plunged into melted wax; the internal part of the wedding ring is cleaned of the wax and of other undesired deposits; die-casting with lost wax is performed, as already described;

the wax is manually spread around the wedding ring and die-casting with lost wax is performed.

I claim:

1. A ring for symbolizing important events in the life of an individual, comprising:

an inner ring which symbolizes a first said important event;

an intermediate hollow ring which symbolizes a second said important event, said intermediate ring having an appearance which is different from said inner ring, said intermediate ring completely enclosing the inner ring and being retained on it;

an outer hollow ring which symbolizes a third said important event, said outer ring having an appearance which is different from that of said inner and intermediate rings, said outer ring completely enclosing the inner and intermediate ring and being retained on said intermediate ring.

2. A ring according to claim 1 wherein the outer ring is formed of two interconnected joined halves each of which is a complete circle forming a hollow half-ring, and the intermediate ring is formed of two halves each of which is a complete circle.

3. A ring according to claim 1 wherein the outer ring is formed of two halves each of which is semicircular, and the intermediate ring is formed of two halves each of which is semicircular.

4. A ring according to claim 1 wherein the inner ring includes a precious jewel.

5. A ring according to claim 1 wherein the inner ring is a wedding ring, the intermediate ring is formed of white gold to symbolize a silver wedding anniversary, and the outer ring is formed of red gold to symbolize a golden wedding anniversary.

6. A ring according to claim 1 wherein the intermediate ring is a metal layer which is deformed to cover and conform to the shape of the inner ring and is not adhered to the inner ring so that said intermediate ring can be cut to remove it from the inner ring.

7. A ring according to claim 6 wherein the outer ring is a metal layer which is deformed to cover and conform to the shape of the intermediate ring and is not adhered to the intermediate ring so that said outer ring can be cut to remove it from the intermediate ring.

* * * * *